US010543709B1

(12) United States Patent
Foegelle

(10) Patent No.: US 10,543,709 B1
(45) Date of Patent: Jan. 28, 2020

(54) LABEL BOOK CONTAINING PRINTED STORE LABELS FOR USE ALONG A RETAIL SHELF EDGE

(71) Applicant: John Foegelle, Broken Arrow, OK (US)

(72) Inventor: John Foegelle, Broken Arrow, OK (US)

(73) Assignee: Elite Creative Solutions, LLC, Broken Arrow, OK (US)

( * ) Notice: Subject to any disclaimer, the term of this patent is extended or adjusted under 35 U.S.C. 154(b) by 0 days.

(21) Appl. No.: 16/104,200

(22) Filed: Aug. 17, 2018

Related U.S. Application Data

(60) Provisional application No. 62/648,695, filed on Mar. 27, 2018.

(51) Int. Cl.

| | |
|---|---|
| ***B42D 1/00*** | (2006.01) |
| ***B42D 5/00*** | (2006.01) |
| ***B42D 1/06*** | (2006.01) |
| ***G09F 3/10*** | (2006.01) |
| ***G09F 3/02*** | (2006.01) |

(52) U.S. Cl.
CPC ..... *B42D 1/005* (2013.01); *B42D 1/004* (2013.01); *B42D 1/009* (2013.01); *B42D 1/06* (2013.01); *B42D 5/002* (2013.01); *G09F 3/02* (2013.01); *G09F 3/10* (2013.01); *G09F 2003/0226* (2013.01); *G09F 2003/0269* (2013.01)

(58) Field of Classification Search
CPC ..... B42D 1/004; B42D 5/002; B42D 1/001
USPC ..... 283/81; 281/16
See application file for complete search history.

(56) References Cited

U.S. PATENT DOCUMENTS 1,927,266 A * 9/1933 Huttner ..... B42C 1/00 283/52
4,193,498 A * 3/1980 Rowling ..... B42C 3/00 281/16

(Continued)

FOREIGN PATENT DOCUMENTS

CH 140735 A * 6/1930 ..... B42D 5/002
FR 1226001 A * 7/1960 ..... B42D 5/002

(Continued)

OTHER PUBLICATIONS

FR-2956062-A3 English Translation (Year: 2011).*

(Continued)

*Primary Examiner* — Kyle R Grabowski
(74) *Attorney, Agent, or Firm* — Gable Gotwals

(57) ABSTRACT

Embodiments of a store label booklet include a plurality of sheets stacked one on top of the other and connected to a binding that spans an entire thickness of the booklet, each sheet including a planar array of store labels. No release coating is used. In some embodiments, the label may include a printed stock side, a liner including a removable portion, and an adhesive located between the liner and the printed stock side. In other embodiments the booklet may include a cardstock with a printed stock side and an adhesive on the side opposite the printed stock side. Each store label may differ in orientation, size, or style and may contain different product information. Location information may be located on a binding of the booklet, on the label, or on both the binding and the label. The store labels may be printed in a predetermined order.

14 Claims, 5 Drawing Sheets

(56) References Cited

U.S. PATENT DOCUMENTS 5,948,494 A * 9/1999 Levin ..... B42D 5/003 283/81
6,116,650 A * 9/2000 Nijboer ..... B42D 5/00 281/16
6,981,343 B2 * 1/2006 Rawlings ..... G09F 3/0288 283/81
9,199,427 B2 12/2015 Weidauer et al.
9,213,506 B2 12/2015 Nunez
9,259,891 B2 2/2016 Weidauer et al.
9,376,286 B1 6/2016 Browning et al.
9,399,331 B2 7/2016 Weidauer et al.
9,434,125 B2 9/2016 Blackwell et al.
9,440,409 B2 9/2016 Blackwell et al.
9,533,464 B2 1/2017 Weidauer et al.
9,547,464 B2 1/2017 Nunez
9,607,531 B2 3/2017 Weidauer et al.
9,802,769 B1 10/2017 Browning et al.
2006/0068145 A1 * 3/2006 Chandaria ..... B42D 5/003 428/40.1
2015/0202907 A1 * 7/2015 Dale ..... B42D 5/00 283/81

FOREIGN PATENT DOCUMENTS

FR 1445376 A * 7/1966 ..... B42D 1/001
FR 2956062 A3 * 8/2011 ..... B42D 1/001

OTHER PUBLICATIONS nexgenpackaging.com, "page from website", , Publisher: https://www.nexgenpackaging.com/.
vestcom.com, "page from website", , Publisher: http://vestcom.com/stackz/.

* cited by examiner

LABEL BOOK CONTAINING PRINTED STORE LABELS FOR USE ALONG A RETAIL SHELF EDGE

CROSS-REFERENCE TO CO-PENDING APPLICATION

The present application claims priority to U.S. Provisional Application No. 62/648,695, filed Mar. 27, 2018, which is incorporated herein by reference.

BACKGROUND

This disclosure is in the field of printed store labels like those used along a retail shelf edge.

Prior art embodiments include store labels or shelf tags (also called talkers) that arrive at the store as a perforated sheet. The labels, which may or may not be in planogram order, must first be removed as a sheet by detaching the perimeter waste strips and then individually removed from the sheet for hanging along the retail shelf edge.

Another prior art embodiment, NEXGEN (Grandville Printing, Grandville, Mich.), arrives at a store location like a box of cards, with the store labels detached from one another, organized in a box and sorted in planogram order. Because the deck of labels has no linear tie or linkage between adjacent labels, the labels may be sorted through to select a specific label in the deck. However, the deck risks losing its predetermined order due to searching, shuffling, or accidental dropping.

One other prior art embodiment, STACZ (Vestcom, Little Rock, Ark.), arrives at a store location like a stack of POST-IT notes, with the store labels arranged in planogram order on a board. Once a (vertical) stack of labels is selected and removed from the board, the labels are removed in top-down fashion, with each label peeled off the top of the stack in order. Because the stack has a linear tie between adjacent labels, if a label other than the top label is desired the stack must be broken into two parts and joined back together once the desired label is removed. Additionally, the label requires a release coating on its face and an adhesive on its back.

SUMMARY

Embodiments of a store label book of this disclosure may include a binding connecting two or more sheets containing printed store labels, each sheet removable from the binding. The labels may be of a kind configured for use along a retail shelf edge and may differ between the sheets. Each sheet may include a single row of labels or multiple rows of labels. Each row may contain a single label or multiple labels. Adjacent labels may be connected by a perforation. The labels may be printed in a predetermined order.

In some embodiments, the sheet contains two or more booklets of labels that may be detachable from one another. At least one label of each sheet may be removable connected to a binding. The booklet may contain N sheets, with each sheet containing a row or planar array of M labels, where N>1 and $M=(A_R/A_{L\ AVG})$, where $A_R$ is the total area of the row, $A_{L\ AVG}$ is the average area of each label of the row, $(A_R/A_{L\ AVG})$ is rounded down to the nearest integer value ≥1, N and M being integer values. Because the booklet is connected to the binding, the booklet may be searched and a desired label or sheet removed without affecting any other sheet's connection to the binding.

The label may include a printed stock side, a liner including a removable portion, and an adhesive located between the liner and the printed stock side. In other embodiments, the label includes a printed stock side having no liner or adhesive. In yet other embodiments, the label includes a printed stock side and an adhesive on the side opposite the printed stock side. The printed stock side of each store label may differ in size or style and may contain different product information and each sheet of the booklet may be arranged in a same or different predetermined order. Location information may be located on the binding, on the label, or on both the binding and the label. In embodiments, there is no perimeter waste strip.

Other embodiments of a store label booklet of this disclosure may include a binding that runs the entire length of a side of the booklet. The binding may also run less than the entire length. The binding may include a location identifier. Two or more sheets are connected to the binding, each of the sheets including at least one planar array of store labels (which may be arranged in a predetermined order). At least one store label of the planar array may be removably connected along one edge to the binding and adjacent store labels of the planar array may be removably connected to one another along a shared edge. The connection may be a perforation.

Each store label of the planar array may include a printed stock side. The printed stock side of at least one store label of the planar array may contain different product information than at least one other store label of the planar array.

Advantages of a label book of this disclosure over the prior art include but are not limited to labels that arrive at an end user ready for use; labels that may be removably connected to one another by perforations; sheets that are not limited to a single label per sheet or a single booklet per sheet; a binding that remains connected to all of the sheets and may include location identification information; an ability to sort through sheets or labels while the sheets remain connected to the binding and remove a select sheet or label without having to disassemble and reassemble the book or risk re-ordering the sheets or labels; labels that may differ in size, style, and orientation from one another; eliminating the need for card-style box or a board to hold stacks of labels; eliminating a release coating on the printed stock side; accommodating labels that have no adhesive (as well as those that include adhesive); and no perimeter waste strip.

ELEMENTS AND NUMBERING USED IN THE DRAWINGS AND DETAILED DESCRIPTION

Figure 1:
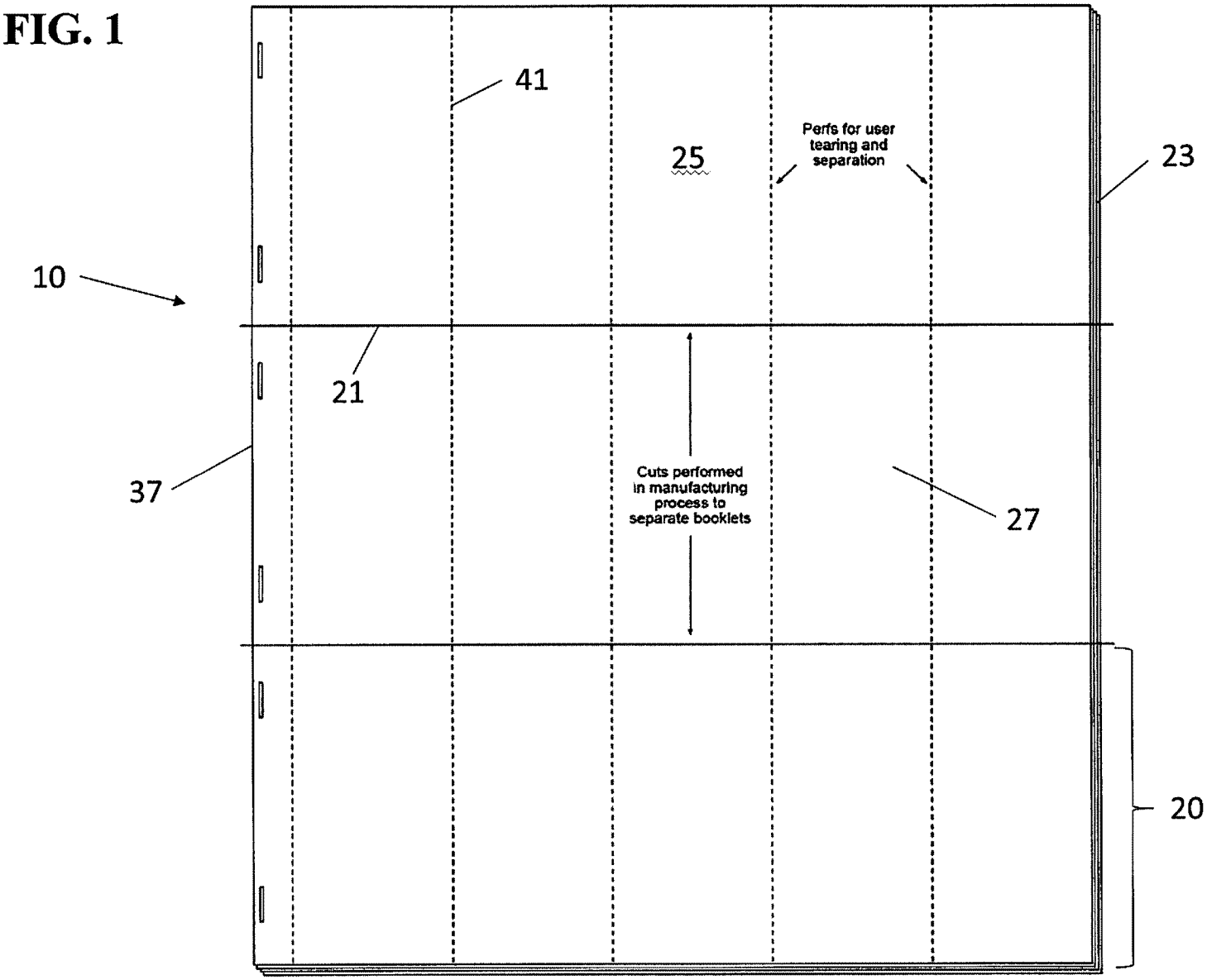
FIG. 1 is an embodiment of an assembled label book of this disclosure during manufacturing. The assembled label book includes a plurality of label booklets and may be cut during manufacturing to separate the booklets. Each detachable label booklet including a plurality of bound pages or sheets with store labels. The store labels may be printed in a predetermined order on each page.
Figure 2:
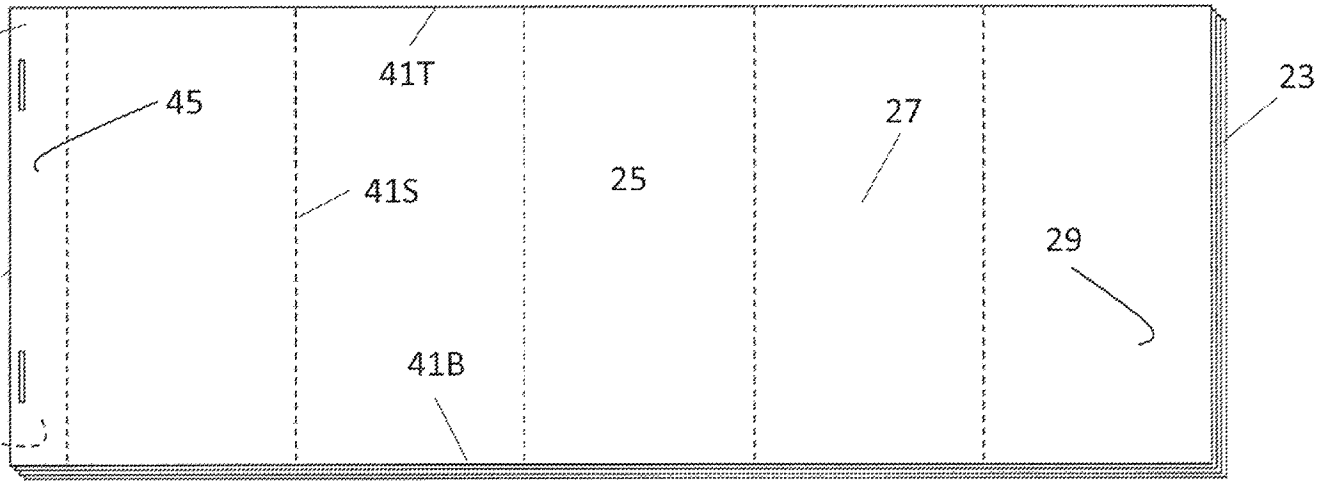
FIG. 2 is an embodiment of a label booklet detached from an assembled label book of FIG. 1. The label booklet may be configured to include only a single label on each page or, as shown in FIG. 2, two or more labels.
Figure 3:
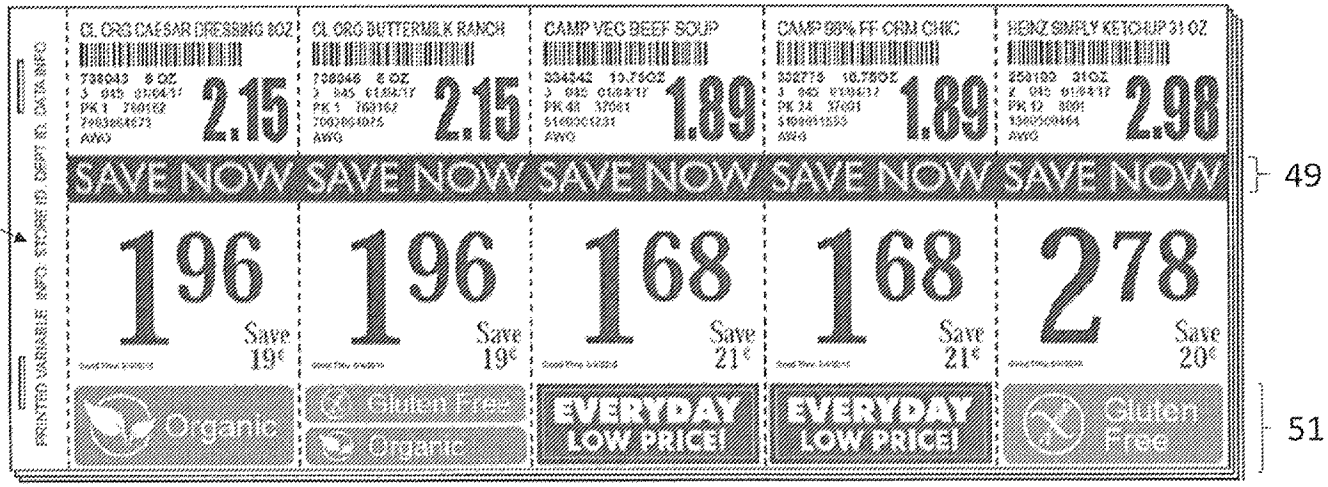
FIG. 3 is an embodiment of a label booklet having a number printed store labels. Each label contains fixed information and variable information such as different product information. Location identifying information may be printed on the binding and may be included on the labels.
Figure 4:
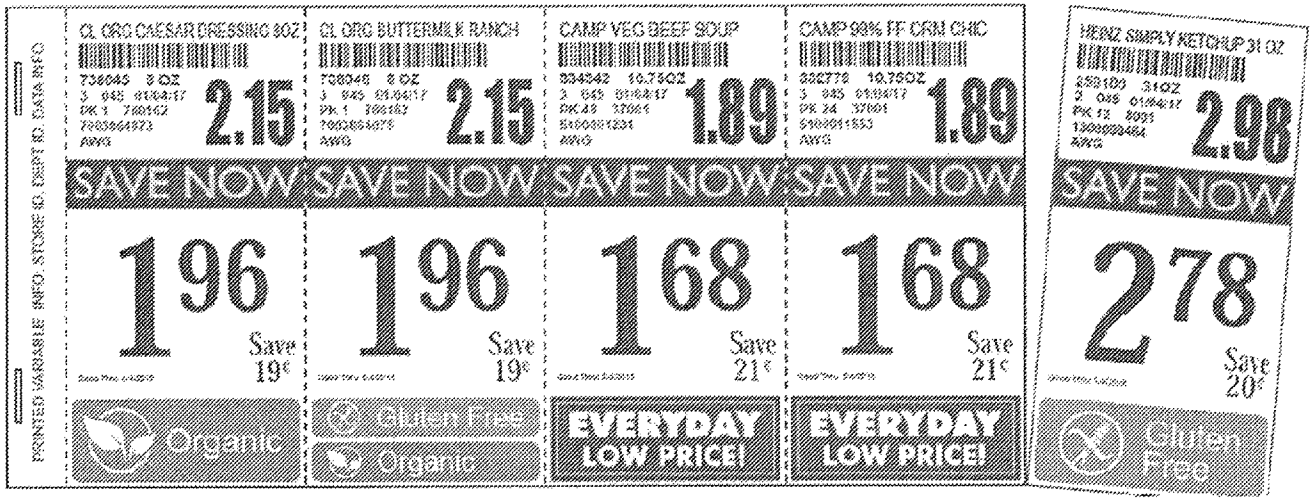
FIG. 4 is a view of a store label being detached from its adjacent store label. In embodiments, adjacent labels are connected by a perforated edge.
Figure 5:
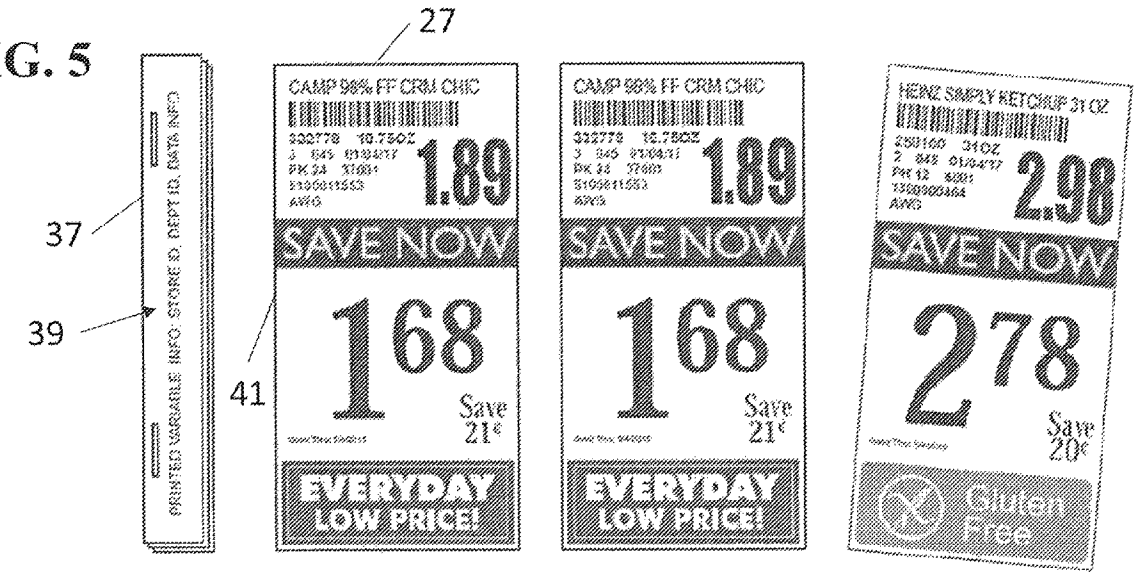
FIG. 5 is the labels of FIG. 4 completely detached (as a last remaining sheet) from the label booklet.
Figure 7:
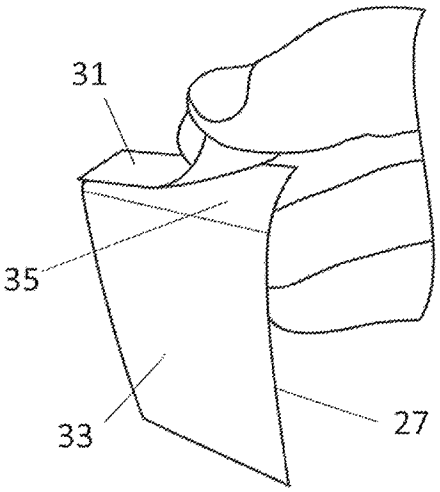
FIG. 7 is a view of the liner side of the label of FIG. 6.
Figure 9:
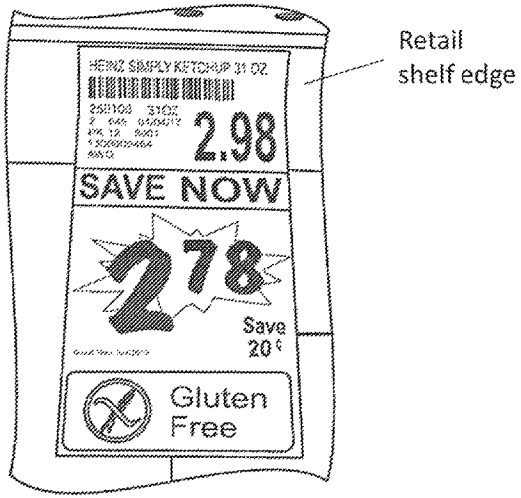
FIG. 9 is a view of the label of FIG. 6 when adhered to the store shelf edge.
Figure 6:
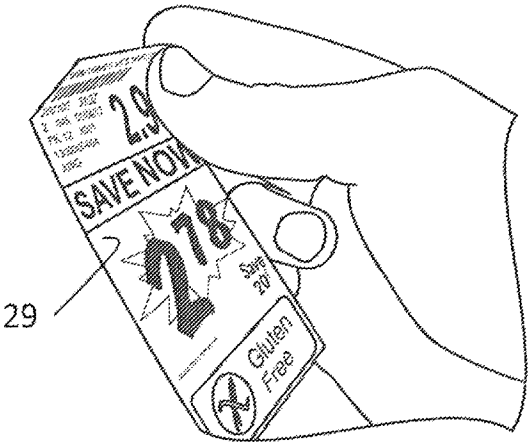
FIG. 6 is an embodiment of a detached store label of this disclosure. The liner includes a removable portion located toward an edge of the label to expose an adhesive. Other embodiments may include no liner or adhesive or may make use of an adhesive strip applied to the back of the label.
Figure 8:
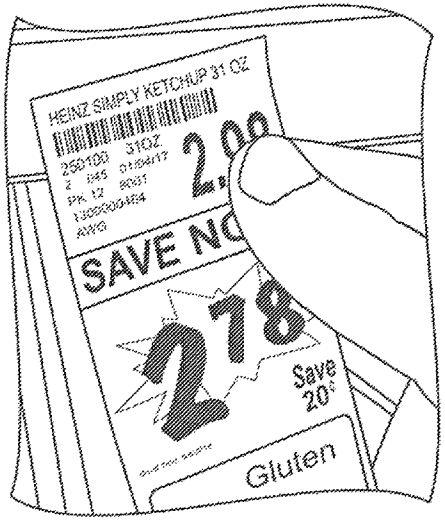
FIG. 8 is a view of the label of FIG. 6 as it is being positioned for application to a store shelf edge.
Figure 10:
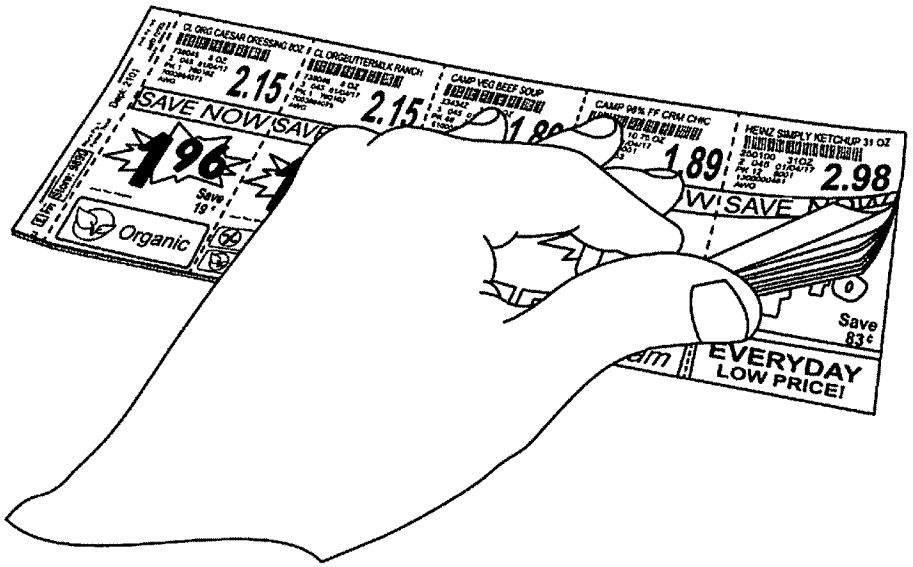
FIG. 10 is an embodiment of a label booklet of this disclosure. Store labels of one sheet of the booklet may be different than those printed on other sheets of the booklet.
Figure 11:
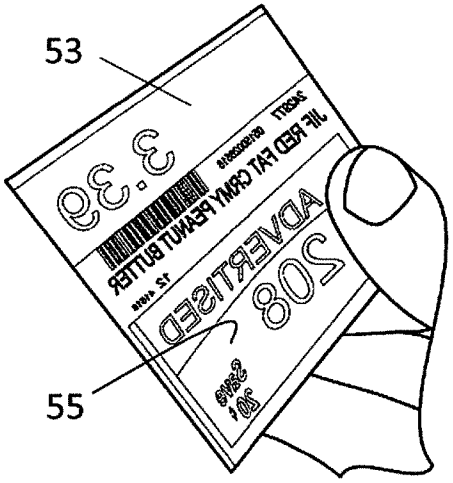
FIG. 11 is an embodiment of a store label made of an appropriate media, such as but not limited to cardstock, and including an adhesive strip that may be added. The label booklet includes a plurality of these store labels.
Figure 12:
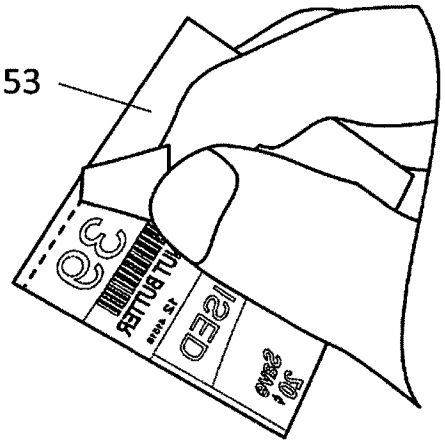
FIG. 12 is view of the store label of FIG. 11 with the adhesive of the strip being exposed.

10 Assembled label book containing one or more label booklets
20 Label booklet
21 Shared edge
23 Plurality of sheets
25 Planar array
27 Shelf tags, store labels, or talkers
29 Printed stock side
31 Removable portion
33 Liner side
35 Adhesive
37 Binding
39 Location identifier
41 Edge
43 Corner
45 Front side
47 Back side
49 Fixed information (common to all labels)
51 Variable information
53 Adhesive strip
55 Back side

DETAILED DESCRIPTION

Referring the drawing figures, embodiments of this disclosure include an assembled label book 10 that may contain one or more label booklets 20. The label booklets 20 may be detachable that are detachable from one another along a shared edge 21, such as but not limited to a perforated edge, or may be separated by cutting. Each label booklet 20 includes plurality of sheets 23 that each contain a planar array 25 of shelf tags or store labels 27 printed in a predetermined order and detachable from one another. The planar array 25 may be a row or column of a sheet 23. The booklet 20 may contain N sheets, with each sheet containing a row or planar array of M labels, where N>1 and $M=(A_R/A_{L\ AVG})$, where $A_R$ is the total area of the row, $A_{L\ AVG}$ is the average area of each label of the row, $(A_R/A_{L\ AVG})$ is rounded down to the nearest integer value ≥1, N and M being integer values. The row may be arranged horizontally with the binding along the side of the N sheets or vertically with the binding along the top or bottom of the N sheets.

In embodiments, the printed stock side 29 of the labels 27 does not include a release coating. A removeable portion 31 of the liner side 33 exposes adhesive 35 for attaching the label 27 to a store shelf edge E. Because the label booklets 20 are arranged in a predetermined order in addition to providing location information and ease of detachment, significant labor savings may be realized by a user.

The booklet 20 includes a binding 37 to which the sheets 23 of the booklet 20 are removably connected. For the purposes of this disclosure, a binding is a shared connector that spans a total thickness of the booklet and allows any sheet of the booklet to be removed from the binding without breaking the binding's connection to the other sheets. Prior art embodiments like NEXGEN do not include any binding and others, like STACZ, do not make use of a binding as it is defined here.

In embodiments, the label booklet 20 includes a binding 37 that may include a location identifier 39 and one or more sheets 23 removably connected along an edge 41 to the binding 37. A sheet 23 may be removed from the binding 37 without affecting other sheets 23 of the booklet, which remain connected to the binding 37. The same is true when a label 27 is removed from the sheet 23: the sheet 23 and its remaining labels 27 remain connected to the binding 37. Therefore, the booklet 20 does not require re-assembly when sheet 23 N>1 is removed from the binding 37, where N=1 is the topmost sheet remaining connected to the binding 37 or when a label 27 is removed from an N>1 sheet 23.

The sheets 23 may be connected to the binding 37 along a top or bottom edge, or a side edge 41T, 41B, 41S. In some embodiments, the binding 37 may be located at a corner 43. The binding 37 may also be located at one or more points along an edge 41. The binding 37 may be any binding suitable. For example, the binding 37 may include a paper stock or a plastic binding.

In some embodiments, the binding 37 may include an adhesive or one or more mechanical fasteners such as but not limited to a staple or a rivet. The sheets 23 containing the one or more labels 27 are connected to a binding 37.

The location identifier 39 may be a store identifier, a department identifier, an aisle identifier, a category identifier, a planogram identifier, a program identifier, or some combination of these identifiers or their equivalent. The location identifier 39 may be printed on a front 45 or back 47 side of the binding. In some embodiments, one location identifier 39 is printed on the front side 45 of the binding 37 and another location identifier 39 is printed on the back side 47. The front and back side location identifiers 39 may include the same identifiers or different identifiers.

Each sheet 23 may be configured as a planar array 25 of store labels 27 arranged in a predetermined order. Adjacent store labels 27 of the planar array 25 may be removably connected to one another along a shared edge 21. The assembled label book 10 may be delivered to an end user for disassembly by the end user into the one or more label booklets 20. Alternatively, the assembled label book 10 may be disassembled at the printer and the one or more label booklets 20 delivered to the end user for immediate use. For example, the label book 10 may be cut to produce two or more label booklets 20. Because the sheets 23 are connected to the binding 37, perimeter waste strips are eliminated (either full perimeter or left/right or top/bottom). The only waste is the binding 37 when the booklet 20 is emptied of sheets 23.

The label booklet 20 may include additional sheets 23 configured as a planar array 25 of store labels 27 removably connected to the binding 37 and located directly below, and identical to, the planar array 25 located above it. In some embodiments, an orientation of one store label 27 of the planar array 25 may be different than an orientation of at least one other store label 27 of the planar array 25.

The store label 27 may include a printed stock side 29 on which fixed 49 and variable 51 product information may be printed; a liner 33 located opposite the printed stock side 29 that includes a removable portion 31 located toward an edge 41 of the store label 27; and an adhesive 35 located between the liner 33 and the printed stock side 29. The removeable portion 31 of the liner 33 may be located toward a top edge, a bottom edge, or a side edge 41T, 41B, 41S of the store label 27. The adhesive 35 may be of a kind well known in the art and used to adhere store labels to a retail shelf edge.

In embodiments, the sheet 23 may include identifying information on a back side 47 of the sheet 23. By way of a non-limiting example, a location identifier 39 the same or similar to that discussed earlier may be included on the back 47 of each store label 27. For example, in some embodiments the location identifier 39 may be a number, a planogram spot, or a department (or some combination thereof). This feature can be useful if a store label 27 is detached from the booklet 20 and the binding 37 cannot be referenced or located.

In embodiments, each label 27 may have variable data 49. For example, in some embodiments the variable data 49 may include the stock keeping unit ("SKU"). Adjacent labels 27 may reference a different SKU. Each label 27 may have the same style or image or can have its own style or image independent of the label 27 adjacent to it. Each row or column of labels 27 on the sheet 23 can be (but does now have to be) a similar printed style to labels 27 adjacent to it. For example, labels 27 may transition from SALE, to TEMPORARY PRICE REDUCTION OR TPR, to AS ADVERTISED to NUTRITIONAL or GLUTON FREE tag all in same row if desired. The labels 27 may be arranged in department sequence, planogram order, or some other order required by an end user.

A shared edge 21 of adjacent store labels 27 may include a perforated edge. The shared edge 21 may be a top, bottom, or side edge 41. The printed stock side 29 of at least one store label 27 of the planar array 25 may contain the same or different product information than that of at least one other store label 27 of the planar array 25. The orientation of each store label 27 may be the same or different than that of another store label 27 of the array 25. In some embodiments, the size of the labels 27 may differ in the array 25.

In embodiments, the booklet 20 may be made of any appropriate media including, but not limited to, paper-based media (e.g. cardstock or its equivalent), a laminated paper-based media, a film or thermoplastic material (e.g. polypropylene or its equivalent), or a fabric material (e.g. polyester). In some embodiments, the booklet 20 does not make use of a liner 33 including a "crack-and-peel" to expose the adhesive 35. The booklet 20 may include the appropriate media without adhesive or a liner and may include an adhesive strip 53, similar to double-sided tape strip or its equivalent, that is applied to the back side 55 of the media.

Embodiments of a booklet of this disclosure are not tied to a specific method of adhesive and liner. For example, embodiments are not limited to a crack-and-peel liner designed to expose the adhesive. In some embodiments the booklet may be cardstock having no adhesive. The adhesive may be an adhesive strip applied to the back with a liner to pull off (e.g., double-sided tape or its equivalent). Additionally, the store labels contained in the booklet may having printed data or information on the back side. For example, a label identifier or planogram location may be printed on the back of the label. Identifying information printed on the front of the label may be limited to that which assists store personnel should the label become detached from the binder.

A booklet of this disclosure may include one or more of the following features combined in various ways:

- a binding;
- a location identifier;
- a binding that includes a location identifier;
- a location identifier located, at least in part, on a front side of the binding.
- a location identifier located, at least in part, on a back side of the binding.
- a store label that includes a location identifier or a portion of the location identifier;
- N sheets or pages, with each sheet containing a row or planar array of M labels, where N>1 and $1 \leq M \leq (A_R/A_L)$ or, where label size is not equal, $\leq (A_R/A_{L\ AVG})$;
- sheets containing at least one planar array of store labels arranged in a predetermined order;
- a sheet selected from the group consisting of a paper-based sheet, a laminated paper-based sheet, a film sheet, thermoplastic sheet, and a fabric sheet;
- adjacent store labels of the planar array removably connected to one another along a shared edge;
- at least one store label of the planar array removably connected along one edge to the binding;
- a store label that includes a printed stock side;
- a store label that does not include a liner or adhesive;
- a store label that includes a liner opposite the printed stock side, the liner including a removable portion located toward an edge of the store label, and an adhesive located between the liner and the printed stock side;
- adhesive that covers a portion of the side located toward an edge of the at least one store label;
- a printed stock side that does not include a release coating;
- a back side of the label or liner including a location identifier.
- a printed stock side of one store label containing different product information than at least one other store label of the planar array;
- another planar array of store labels located directly below, and identical to, the at least one planar array;
- an orientation of one store label of the planar array relative to the binding being different than an orientation of at least one other store label of the planar array;
- another planar array of store labels removably connected along a shared edge to the at least one planar array;
- product information contained on the printed stock side of at least one store label of the another planar array being identical to that contained on the printed stock side of an adjacent store label of the at least one planar array;
- product information contained on the printed stock side of at least one store label of the another planar array being different than that contained on the printed stock side of an adjacent store label of the at least one planar array;
- at least one location identifier selected from the group consisting of a store identifier, a department identifier, an aisle identifier, a category identifier, and a planogram identifier;
- a shared edge that is a top edge, a bottom edge, or a side edge;
- a shared edge that includes a perforation;

a removeable portion of the liner located toward a top edge, a bottom edge, or a side edge of the store label;

a binding running along at least a portion of an edge of the booklet;

a binding at a corner of the booklet;

a binding that includes a paper stock;

a binding that includes an adhesive.

a binding that includes one or more mechanical fasteners;

a binding that includes a plastic binding;

a binding that is not an adhesive on the face or back of a sheet.

The embodiments described in this disclosure are provided as examples of the label book and booklets. The following claims include the full range of equivalents to which each recited element is entitled.

The invention claimed is:

1. A book of store labels comprising:

a first booklet and a second different booklet;

a binding spanning an entire thickness of the book and including an edge spanning an entire end length of the first and second booklets, the first booklet and its respective binding detachable from the second different booklet and its respective binding;

a plurality of N sheets removably connected at one end to the edge of the binding, each of the N sheets containing two planar arrays of M store labels, one of the planar arrays corresponding to the first booklet and containing a first set of store labels and another of the planar arrays corresponding to the second different booklet and containing a second different set of store labels;

each store label of a planar array removable from an adjacent store label along a shared edge, each sheet being reduced in area as a store label is removed from its respective planar array, there being no perimeter waste remaining connected to the sheet;

each store label of the M store labels including:

a printed stock side extending an entire width and length of the store label and containing product information different than other store labels of the planar array, a liner located opposite the printed stock side and extending the entire width and length of the store label, and an adhesive located between the liner and the printed stock side, the liner including a removable portion located toward an edge of the store label and a fixed portion;

a first and a second different location identifier associated with the first and the second different booklet, the first location identifier located on a front and a back of a portion of the binding corresponding to the first booklet and on a back of the liner of each store label of the first booklet, the second different location identifier located on a front and a back of another portion of the binding corresponding to the second different booklet and on the back of the liner of each store label of the second different booklet.

2. A book according to claim 1, further comprising the first and second location identifier being at least one location identifier selected from the group consisting of a store identifier, a department identifier, an aisle identifier, a category identifier, and a planogram identifier.

3. A book according to claim 1, wherein the planar array of M store labels is arranged in a predetermined order.

4. A book according to claim 1, wherein the shared edge includes a perforation.

5. A book according to claim 1, wherein a size, an orientation relative to the binding, or a size and orientation of one store label of the planar array of M store labels is different than a size, an orientation, or a size and orientation of at least one other store label of the planar array.

6. A book according to claim 1, wherein the printed stock side does not include a release coating.

7. A book according to claim 1, each of the N sheets is a sheet selected from the group consisting of a paper-based sheet, a laminated paper-based sheet, a film sheet, thermoplastic sheet, and a fabric sheet.

8. A book according to claim 1, the binding including a paper stock.

9. A book according to claim 1, the binding including a plastic.

10. A book according to claim 1, the binding including a fastener selected from the group consisting of a mechanical fastener and a non-mechanical fastener.

11. A book according to claim 1, M being in a range of 2 to 12.

12. A book according to claim 1, M being in a range of 2 to 10.

13. A book according to claim 1, M being in a range of 2 to 8.

14. A book according to claim 1, M being in a range of 2 to 6.

* * * * *